US007637198B2

(12) United States Patent
De Villiers et al.

(10) Patent No.: US 7,637,198 B2
(45) Date of Patent: Dec. 29, 2009

(54) INDIRECT FIRE WEAPON AIMING DEVICE

(75) Inventors: Daniel De Villiers, Ninapark (ZA); Douw Gerbrand Steyn, Wonderboom (ZA); Pieter Francois Smith, Pretoria (ZA)

(73) Assignee: CSIR (ZA)

( * ) Notice: Subject to any disclaimer, the term of this patent is extended or adjusted under 35 U.S.C. 154(b) by 27 days.

(21) Appl. No.: 11/662,240

(22) PCT Filed: Sep. 8, 2005

(86) PCT No.: PCT/IB2005/052932

§ 371 (c)(1),
(2), (4) Date: Feb. 1, 2008

(87) PCT Pub. No.: WO2006/027753

PCT Pub. Date: Mar. 16, 2006

(65) Prior Publication Data

US 2008/0282877 A1 Nov. 20, 2008

(30) Foreign Application Priority Data

Sep. 9, 2004 (ZA) ..... 04/7231

(51) Int. Cl.
*F41G 3/16* (2006.01)

(52) U.S. Cl. ..... 89/41.17

(58) Field of Classification Search ..... 89/41.17, 89/37.05

See application file for complete search history.

(56) References Cited

U.S. PATENT DOCUMENTS

| | | | | | |
|---|---|---|---|---|---|
| 3,710,675 | A * | 1/1973 | Asikainen | 89/41.17 |
| 4,026,190 | A | 5/1977 | Blair | |
| 4,126,394 | A * | 11/1978 | Ulrich | 356/152.2 |
| 4,365,149 | A | 12/1982 | Falbel | |
| 4,885,977 | A * | 12/1989 | Kirson et al. | 89/41.05 |
| 5,648,633 | A * | 7/1997 | Relange | 89/41.11 |
| 5,686,690 | A * | 11/1997 | Lougheed et al. | 89/41.17 |
| 6,059,573 | A | 5/2000 | Patel | |
| 6,499,382 | B1 * | 12/2002 | Lougheed et al. | 89/41.05 |
| 7,089,845 | B2 * | 8/2006 | Friedli et al. | 89/41.05 |

FOREIGN PATENT DOCUMENTS

| | | |
|---|---|---|
| DE | 3545175 | 7/1987 |

* cited by examiner

*Primary Examiner*—Bret Hayes
(74) *Attorney, Agent, or Firm*—Dean W. Russell; Kilpatrick Stockton LLP

(57) ABSTRACT

An indirect fire weapon aiming device (10) is provided for providing aiming information to an indirect fire weapon comprising a launcher mounted to a base. The device (10) includes an angular displacement sensor (12) mountable to the base to provide an angular displacement output, and an azimuth communicator (14) mountable to the launcher to communicate the launcher azimuth to the angular displacement sensor (12) so that the angular displacement sensor (12) can measure the angular displacement of the launcher relative to a reference bearing and provide the angular displacement output.

14 Claims, 7 Drawing Sheets

INDIRECT FIRE WEAPON AIMING DEVICE

CROSS REFERENCE TO RELATED APPLICATIONS

This application is the U.S. national phase of International Application No. PCT/IB2005/052932 filed on Sep. 8, 2005 and published in English on Mar. 16, 2006 as International Publication No. WO 2006/027753 A1, which application claims priority to South African Patent Application No. 2004/7231 filed on Sep. 9, 2004, the contents of which are incorporated by reference herein.

THIS INVENTION relates to the aiming of indirect fire weapons. In particular, the invention relates to an indirect fire weapon aiming device and to an indirect fire weapon.

According to one aspect of the invention, there is provided an indirect fire weapon aiming device for providing aiming information to an indirect fire weapon comprising a launcher mounted to a base, the device including an angular displacement sensor mountable to the base to provide an angular displacement output; and an azimuth communicator mountable to the launcher to communicate the launcher azimuth to the angular displacement sensor so that the angular displacement sensor can measure the angular displacement of the launcher relative to a reference bearing and provide the angular displacement output.

The azimuth communicator may include a quick release clamp by means of which the azimuth communicator can be mounted to the launcher. The quick release clamp may allow the launcher to rotate within the clamp about a central longitudinal axis of the launcher. The quick release clamp may include bearings in use to bear against the launcher. The bearings may be roller bearings each being arranged to rotate about an axis of rotation which is parallel to the central longitudinal axis of the launcher.

The azimuth communicator may include a mechanical link mountable to the launcher mechanically to link the launcher to the angular displacement sensor. The mechanical link may include at least two arms hingedly connected to one another and respectively to the quick release clamp and the angular displacement sensor, to allow the launcher elevation to be adjustable.

The aiming device may include an elevation sensor or clinometer to sense the elevation of the launcher and to provide an elevation output. The elevation sensor may be mounted or mountable to the azimuth communicator.

The aiming device may include a tilt sensor mountable to the base to measure the tilt of the base about at least one axis and to provide a tilt output. Advantageously, the information provided by the tilt sensor can be used to correct or adjust the angular displacement output when the base is in a non-horizontal plane to obtain an accurate azimuth for the launcher.

The angular displacement sensor may include a reference component fixedly mountable to the base and a displaceable component rotatably mounted to the reference component and mounted to the azimuth communicator, the displaceable component being rotatable about an axis passing through a swivel point of the launcher, in use so that azimuth adjustments to a launcher are communicated to the displaceable component through the azimuth communicator, with the displaceable component thus rotating in unison with the launcher. As will be appreciated by those skilled in the art of measuring angular displacement, the relative angular positions of the reference component and the displaceable component can be used to measure the angular displacement of the displaceable component, and thus the launcher, relative to a reference bearing provided on or by the reference component.

The indirect fire weapon aiming device may be intended for an indirect fire weapon such as a mortar, grenade launcher, or rocket launcher. It is in fact expected that the aiming device of the invention will find particular application with dismounted or man-portable statically deployed indirect fire weapons such as dismounted mortars.

The launcher may thus be a mortar barrel or tube and the base may include a mortar base plate.

When the aiming device is thus intended for a mortar, the reference component of the angular displacement sensor may be configured to be mounted to a mortar base plate, such as a conventional triangular base plate with spiked feet, and may define an aperture in use providing access to a socket base on the base plate so that the ball of a breech block of a mortar can be inserted through the reference component onto the socket base.

Similarly, the displaceable component may define an aperture, aligned with the aperture in the reference component so that the ball of a breech block of a mortar can be inserted through the displaceable component onto the socket base. Thus, the socket base, reference component and displaceable component may together define a rotating socket clamp which is functionally equivalent to a conventional rotating socket clamp of a mortar base plate, at least in as far as the mounting of a mortar barrel to a mortar base plate is concerned.

The angular displacement sensor may include magnetic, optical, induction or resistive sensing capability arranged to measure angular displacement, such as an annular or part annular magnetic strip on the reference component and a magnetic reader on the displaceable component, the magnetic reader being positioned to read the magnetic strip. The displaceable component may define a bottom recess in which the magnetic reader or the like is located so that the magnetic reader or the like is captured between the reference component and the displaceable component. Naturally, the location of the magnetic reader or the like and the magnetic strip or the like may be reversed.

The displaceable component may define a bottom recess in which the tilt sensor is located so that the tilt sensor is captured between the reference component and the displaceable component.

The invention will now be described, by way of example, with reference to the accompanying illustrations in which FIG. 1 shows a three-dimensional view of an indirect fire weapon aiming device in accordance with the invention and a mortar breech block;

Figure 1:
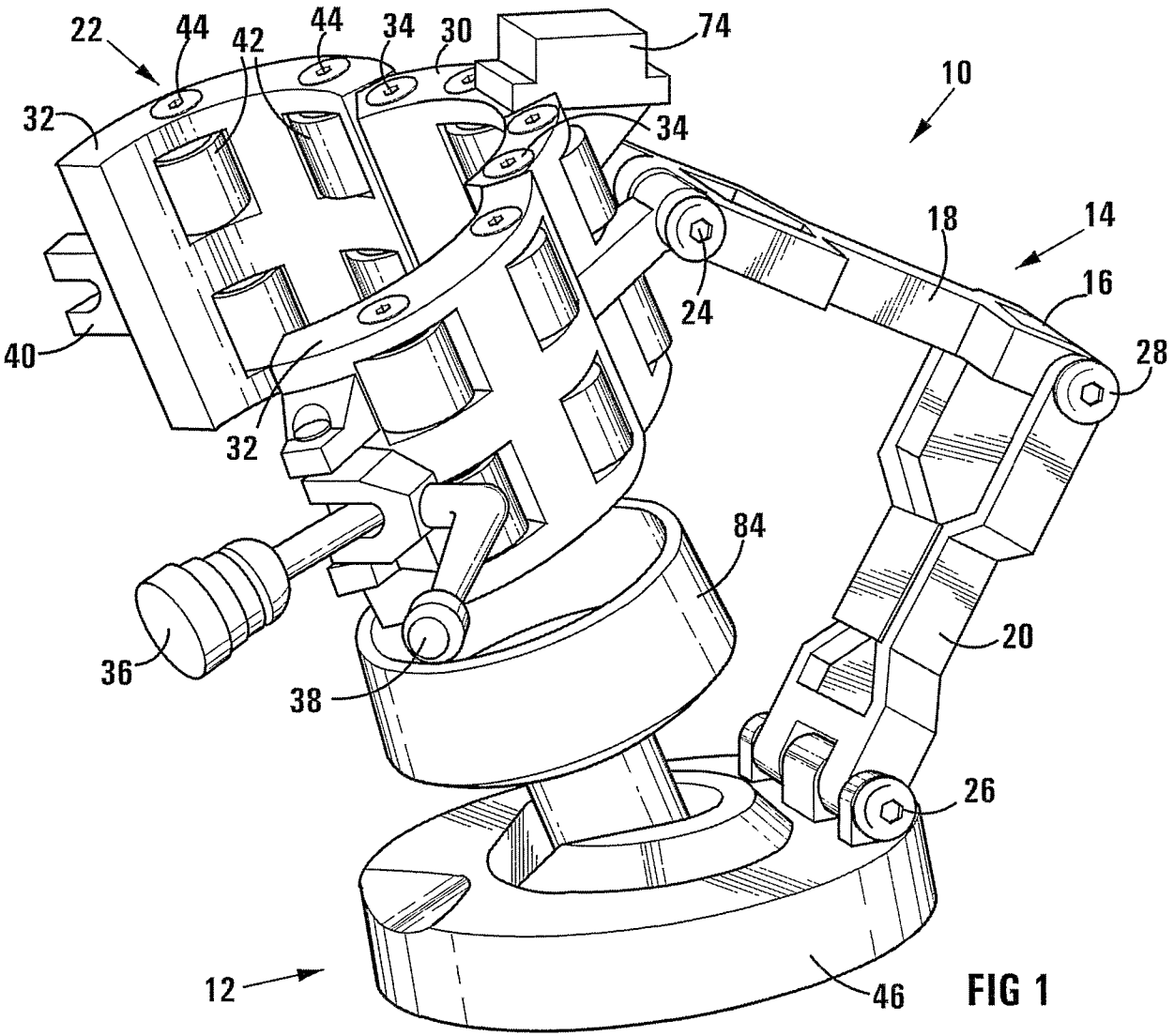
Figure 5:
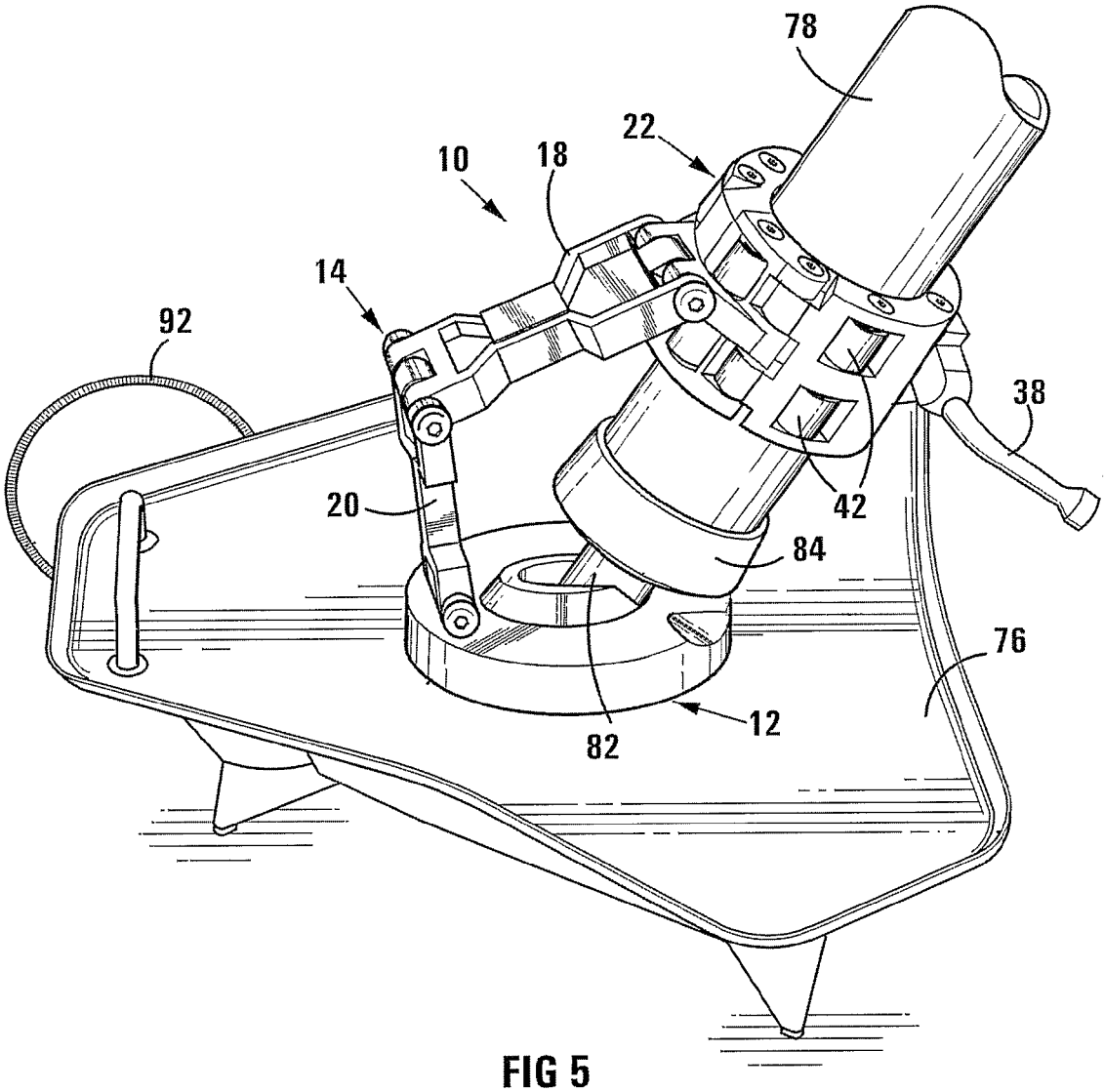
FIG. 5 shows a three-dimensional view of the indirect fire weapon aiming device of FIG. 1, in use, with parts omitted.
Figure 7:
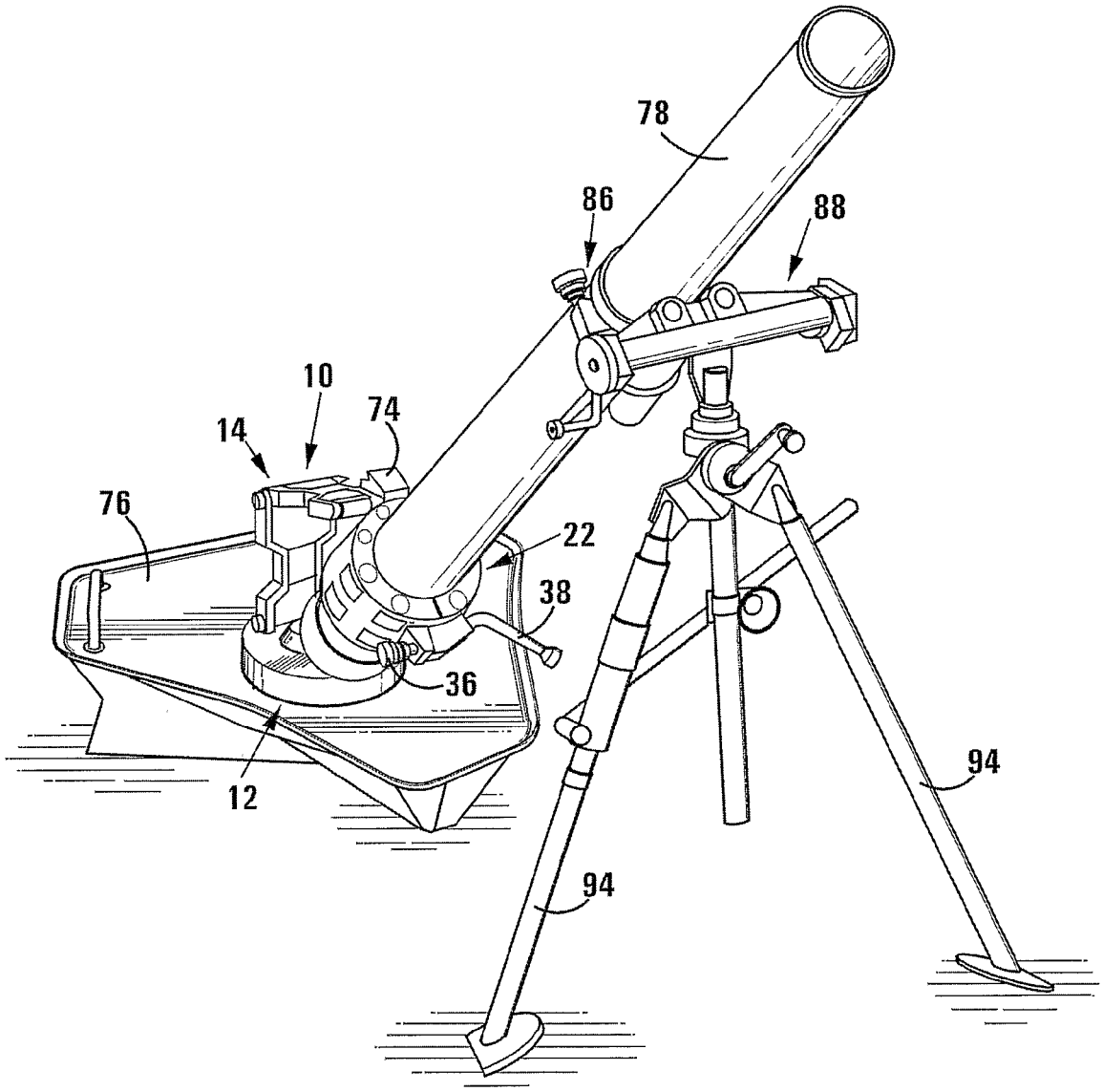
FIG. 7 shows a three-dimensional view of a mortar which includes the indirect fire weapon aiming device of FIG. 1, but with the electronic sight of FIG. 7 omitted.

Referring to FIGS. 1, 5 and 7, reference numeral 10 generally indicates an indirect fire weapon aiming device in accordance with the invention. The device 10 comprises broadly an angular displacement sensor 12 mountable to a base of an indirect fire weapon and an azimuth communicator 14 mountable to a projectile launcher, such as a barrel, of an indirect fire weapon to communicate the launcher azimuth to the angular displacement sensor 12.

The azimuth communicator 14 includes a mechanical link 16 comprising a first arm or limb 18 and a second arm or limb 20. The azimuth communicator 14 further includes a quick release clamp 22. The first arm 18 is hingedly connected to the quick release clamp 22 by means of a hinge pin 24 and the second arm 20 is hingedly connected to the angular displacement sensor 12 by means of a hinge pin 26. The first arm 18 and the second arm 20 are hingedly connected to one another by means of a hinge pin 28.

The quick release clamp 22 includes a fixed collar portion 30 and two hingedly displaceable collar portions or jaws 32. The hingedly displaceable collar portions 32 are hingedly attached to the fixed collar portion 30 by means of hinge pins 34.

The quick release clamp 22 further includes an axis bolt assembly 36 similar to the axis bolt assembly of a conventional mortar barrel clamp assembly and a clamp handle 38. The axis bolt assembly 36 is hingedly attached to the clamp handle 38, which is in turn hingedly attached to one of the hingedly displaceable collar portions 32. A catch formation 40 for the axis bolt assembly 36 is provided on the other of the hingedly displaceable collar portions 32.

Each collar portion 30, 32 includes four roller bearings 42 arranged in a two-by-two matrix. The roller bearings 42 are each free to rotate about an axis of rotation defined by a shaft pin 44.

Figure 2:
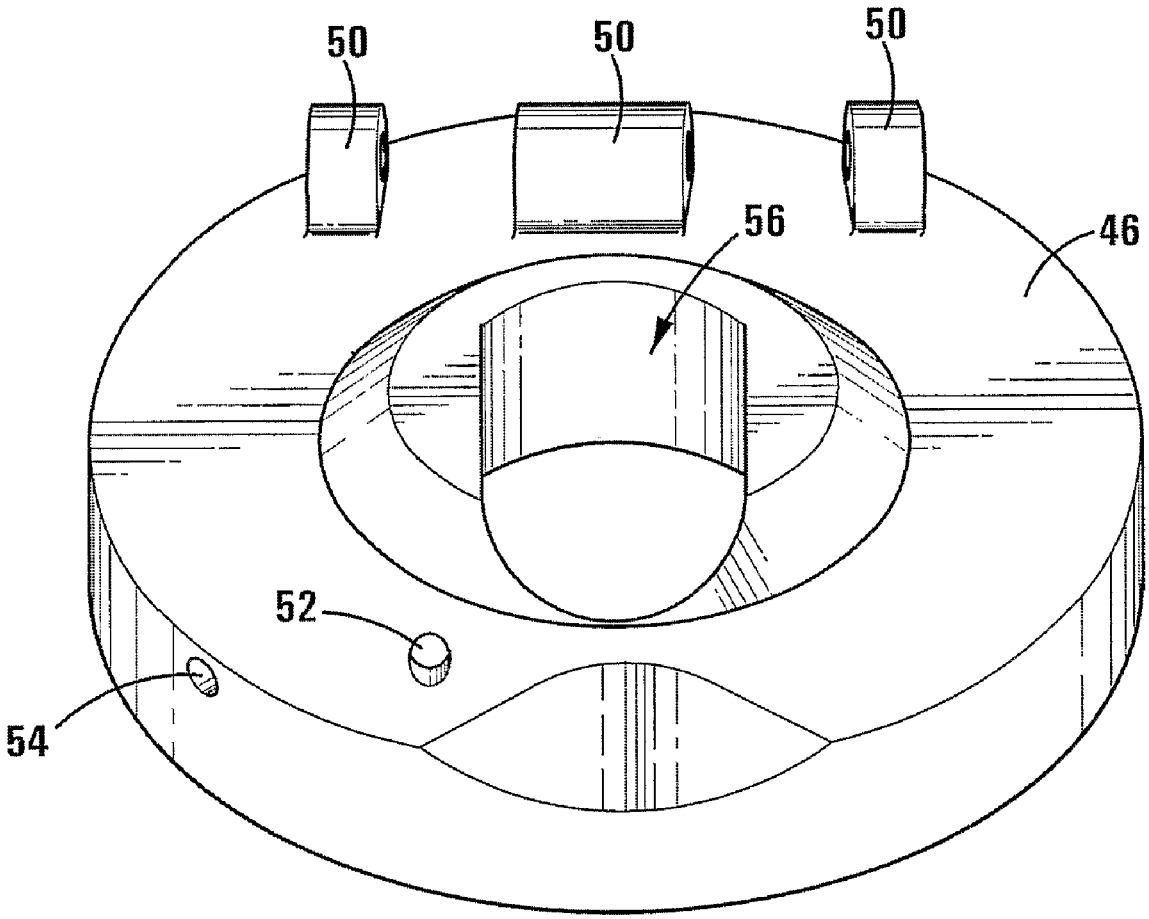
FIG. 2 shows a three-dimensional view of a displaceable component of an angular displacement sensor of the indirect fire weapon aiming device of FIG. 1.
Figure 3:
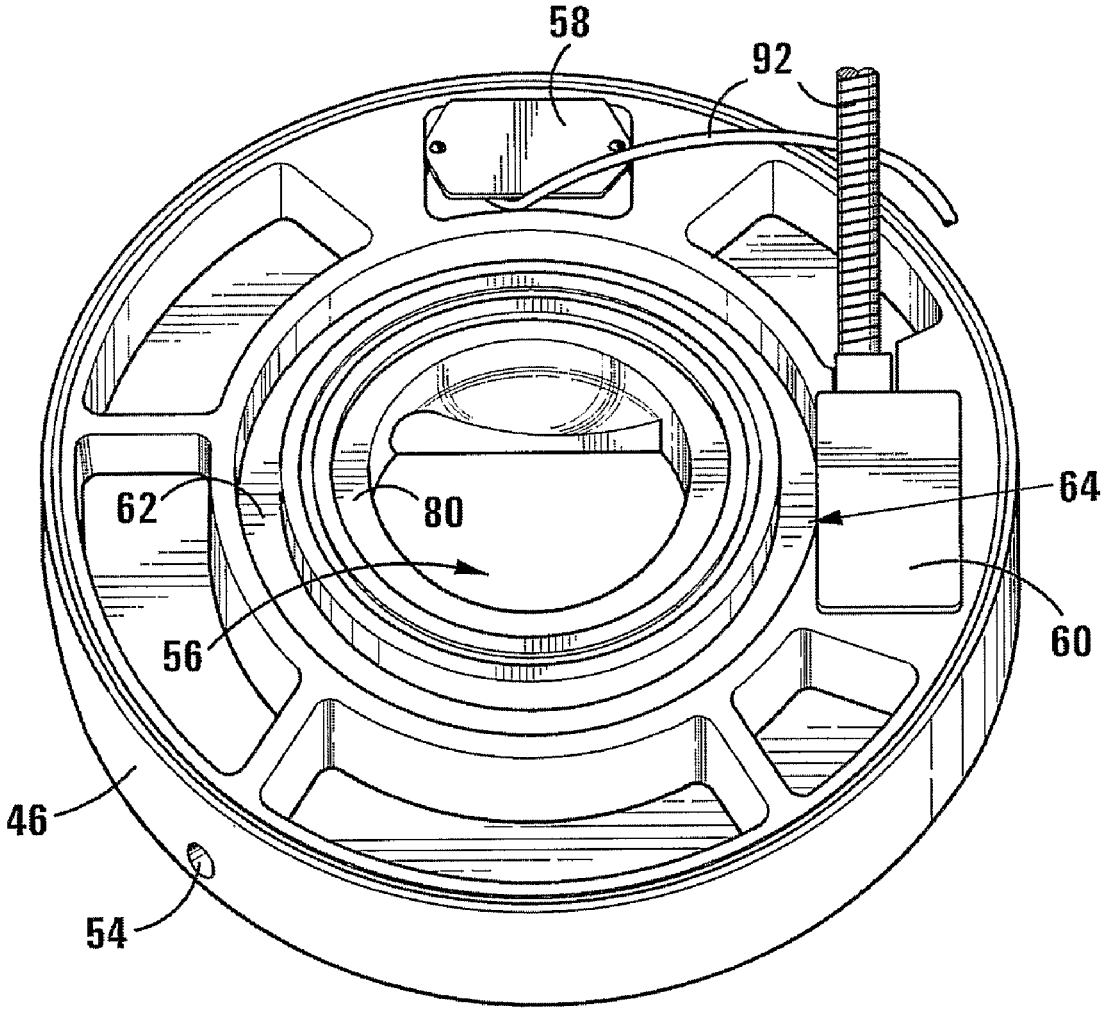
FIG. 3 shows a three-dimensional view of a bottom of the displaceable component of FIG. 2.
Figure 4:
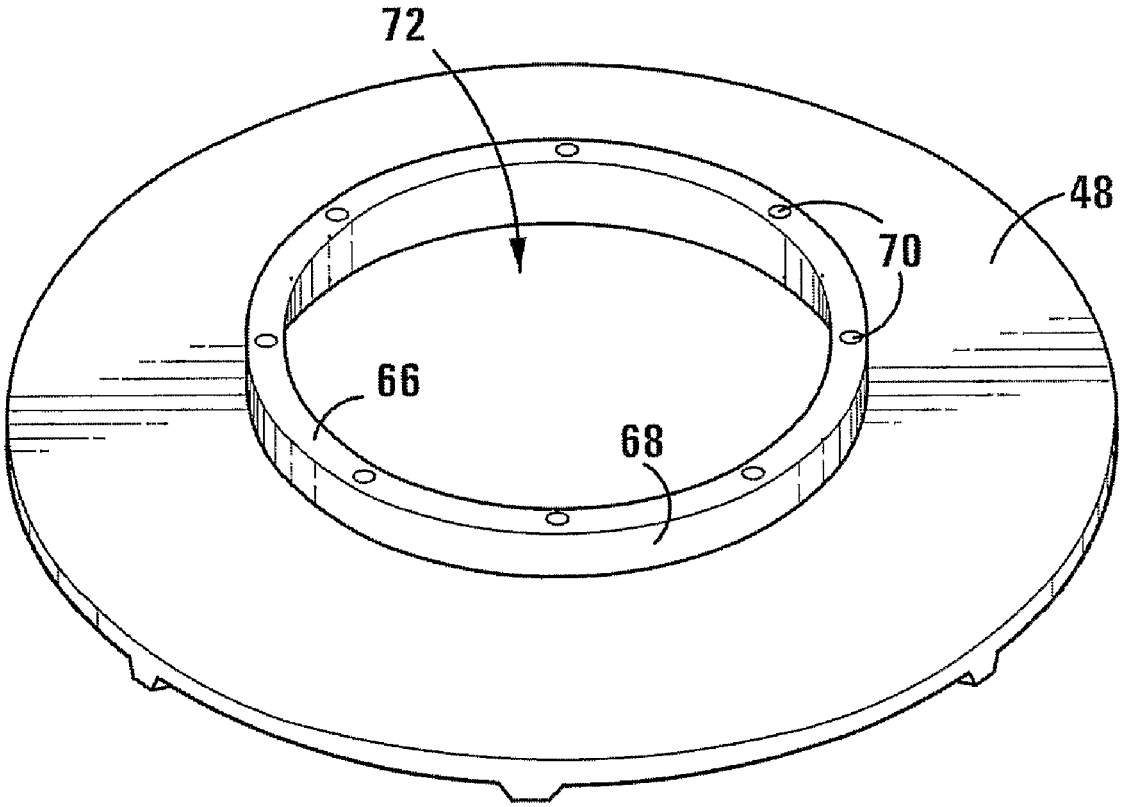
FIG. 4 shows a three-dimensional view of a reference component of the angular displacement sensor.

The angular displacement sensor 12 includes a rotatably displaceable component 46 (see FIGS. 2 and 3) and a reference component 48 (see FIG. 4). The displaceable component 46 defines hinge eyes 50 for the hinge pin 26, a communications port (not shown) through which a communications cable can be threaded, a locking chain opening 52 and a threaded set screw or grub screw passage 54. The locking chain opening 52 is used to insert a locking chain or cable or the like to mount the displaceable component 46 to the reference component 48, in a fashion similar to which a mortar breech piece lock of a rotating socket clamp is mounted to a mortar base plate.

An elongate slot 56 is defined centrally in the displaceable component 46. In an underside of the displaceable component 46, in recesses provided therefor, a tilt sensor 58 and a magnetic reader 60 are located (see FIG. 3). An annular channel 62 is also defined in the underside of the displaceable component 46. The annular channel 62 is open to the magnetic reader 60 at a location which is indicated by reference numeral 64.

The reference component 48 defines an annular raised formation 66 which fits into the annular channel 62. A magnetic strip 68 is attached to an annular outer surface of the annular formation 66 and thus faces the magnetic reader 60 when the displaceable component 46 and the reference component 48 are assembled. As will be appreciated, instead of employing magnetic sensing, optical, induction or resistive sensing, for example, can be used to measure angular displacement. A plurality of circumferentially equiangularly spaced bolt receiving apertures 70 is provided in the annular formation 66 by means of which the reference component 48 can be bolted to a mortar base plate. As can be clearly seen in FIG. 4 of the drawings, the reference component 48 also defines a central aperture 72 which, when the reference component 48 and the displaceable component 46 are assembled, is aligned or is in register with the elongate slot 56 in the displaceable component 46.

The indirect fire weapon aiming device 10 includes an elevation sensor or clinometer 74 (see FIG. 1) mounted to the azimuth communicator 14 and in particular to the fixed collar portion 30 in a recess provided therefor.

As can be clearly seen in FIG. 5 of the drawings, the device 10 is intended for use with a conventional mortar, such as an 81 mm mortar which includes a base plate 76 and a barrel or tube 78. In order to install the device 10, the rotating socket clamp (not shown) of the base plate 76 is removed whereafter the reference component 48 is placed centrally on the base plate 76 with a socket base formation of the base plate 76 protruding through the aperture 72. The reference component 48 is then bolted to the base plate using bolts inserted into the bolt receiving apertures 70, whereafter the displaceable component 46 is placed on top of the reference component 48 with the annular formation 66 of the reference component 48 fitting into the annular channel 62 of the displaceable component 46. A locking chain (not shown) is fed into the locking chain opening 52 and fits between a groove (not shown) on the socket base formation and a corresponding groove 80 on the displaceable component 46, thereby to secure the displaceable component 46 to the base plate 76 whilst still allowing the displaceable component 46 to rotate. Together, the socket base formation of the base plate 76 and the slot 56 in the displaceable component 48 define a rotating socket clamp, similar to the rotating socket clamp of a conventional mortar base plate, to receive a breech block ball 82 of a conventional mortar breech block 84. The breech block ball, as is conventional, has two flat sides which are placed inside the rotating socket clamp whereafter the breech block 84 is turned through 90° to lock the breech block 84 to the base plate 76.

The quick release clamp 22 is clamped to a lower portion of the barrel 78 by means of the axis bolt assembly 36, the catch formation 40 and the clamp handle 38, in similar fashion to which a barrel clamp 86 of a conventional mortar bipod assembly 88 (see FIG. 7) is clamped to the mortar barrel 78.

Figure 6:
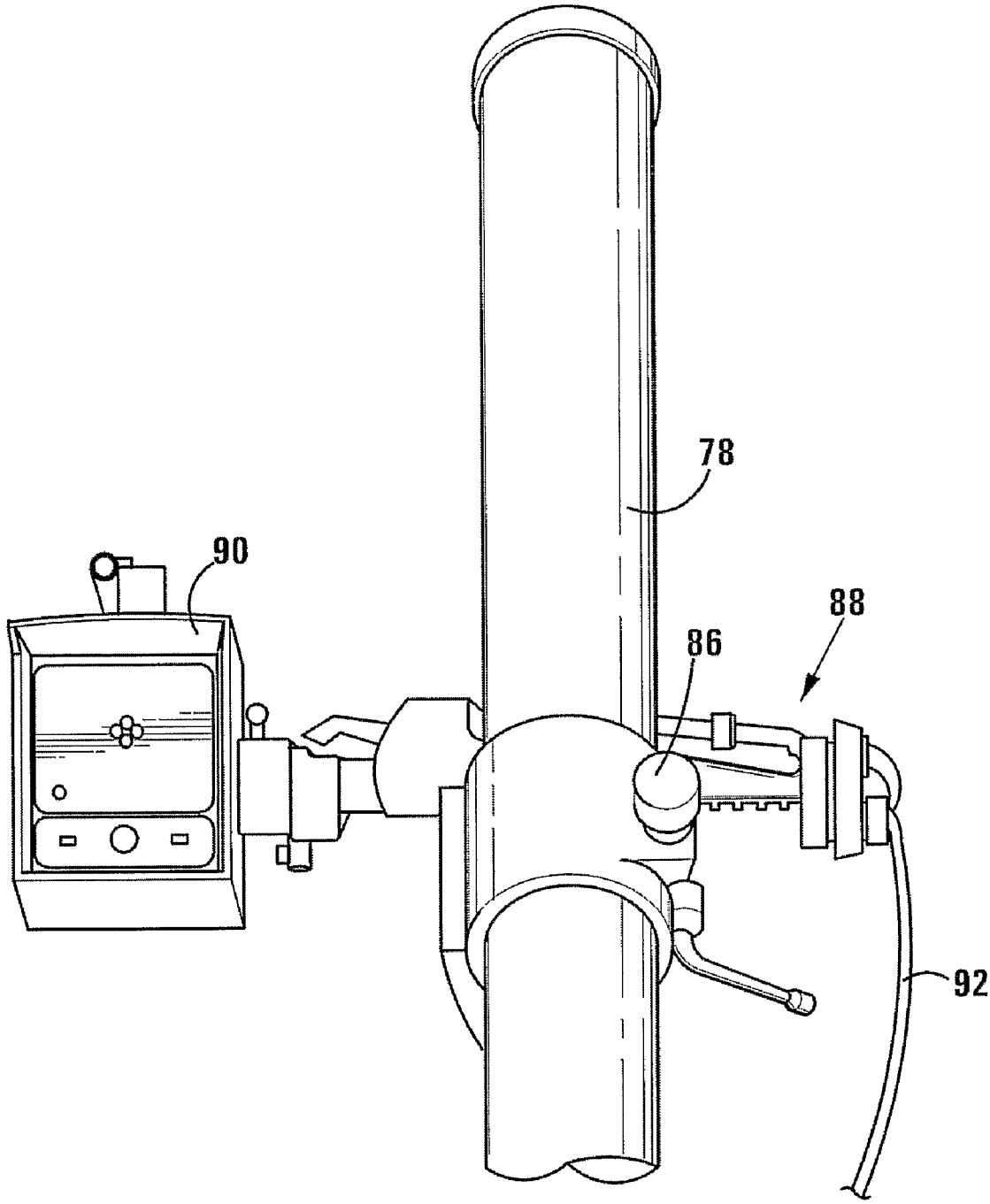
FIG. 6 shows an electronic sight mounted to a mortar, for use with the indirect fire weapon aiming device of FIG. 1.

An electronic sight or indirect aiming sight, such as the IMADTS sight 90 (marketed by Naschem and/or Marine Air Systems) shown in FIG. 6 of the drawings, is also mounted to the barrel 78 and connected to the indirect fire weapon aiming device 10 by means of cables 92 to provide for electronic communication between the device 10 and the sight 90.

In use, by means of the clinometer 74 on the one hand, and the magnetic reader 60 and magnetic strip 68 on the other hand, the elevation of the barrel 78 and the azimuth of the barrel 78 are measured, with output signals being produced which can be fed to the electronic sight 90. The clinometer 74 directly measures the elevation of the barrel 78 as it is mounted on the barrel 78 by means of the azimuth communicator 14. The azimuth of the barrel 78 is communicated from the barrel 78, by means of the quick release clamp 22 and the mechanical link 16, to the displaceable component 46, which thus rotates in unison with the barrel 78 if the azimuth of the barrel 78 is adjusted. Rotation of the displaceable component 46 causes angular displacement of the magnetic reader 60 relative to the magnetic strip 68, allowing the azimuth of the barrel 78 to be measured.

By using the quick release clamp 22 with its roller bearings 42, it is ensured that the barrel 78 can rotate inside the quick release clamp 22 about its longitudinal central axis. Naturally, this implies that the clamping force applied by the axis bolt assembly 36 should not be so high as to prevent rotation of the barrel 78 about its longitudinal axis. It is important for the barrel 78 to be able to rotate about its longitudinal axis, as this is a natural movement of the barrel 78 when the effective length of any of the legs 94 of the bipod assembly 88 becomes shorter than the effective length of the other leg 94, e.g. when one of the legs penetrates the soil during use.

When the base plate 76 is perfectly horizontal, the azimuth of the barrel 78 as communicated to the angular displacement sensor 12 by means of the azimuth communicator 14 can be directly and accurately measured by the angular displacement sensor 12. In other words, an adjustment of 50 mils in the azimuth of the barrel 78 will result in a 50 mils adjustment in the angular position of the magnetic reader 60 relative to the magnetic strip 68. However, when the base plate 76, and thus the magnetic strip 68, is not in a perfectly horizontal plane, this no longer holds true and the angular displacement measured by means of the angular displacement sensor 12 must be adjusted or corrected to take into account the plane in which the magnetic strip 68 is located. This is achieved by measuring the orientation of the plane in which the magnetic strip 68 is located, using the tilting sensor 58. By feeding this information to the sight 90, the sight 90 can effect the necessary corrections or adjustments, using conventional mathematics and programming algorithms.

The indirect fire weapon aiming device of the invention can easily be integrated into an indirect targeting system. Setting up an indirect fire weapon such as a mortar may take easily from between about 3½ minutes to 7 minutes. This time is reduced to less than a minute by using the indirect fire weapon aiming device of the invention as part of an indirect targeting system. The human errors occurring with conventional targeting methods are avoided with such an indirect targeting system, which also reduces other system errors making it safer, quicker onto target, more accurate and more economical from an ammunition usage point of view. Such an indirect targeting system would also be orders of magnitude cheaper than an inertial navigation system.

Advantageously, the aiming device of the invention, as illustrated, allows for a mortar barrel orientation to be determined regardless of the mortar bipod orientation. The practical effect of this is that the bipod can be picked up and moved to a new position (for aiming on a new target that differs substantially in bearing from a previous target) and the barrel orientation would be available immediately to the electronic sight. This allows for quick reaction time to new targets of opportunity. Advantageously, the aiming device of the invention, as illustrated, can be mounted to a mortar base plate in the same manner as the conventional rotating socket clamp of a mortar base plate, allowing the aiming device to function as an aiming device and at the same time to secure a mortar barrel onto the base plate. It is easy to seal the displaceable component and the reference component to each other whilst still allowing relative rotation, e.g. by means of O-rings or the like allowing the base of the indirect fire weapon to be immersed in water or to be used in very dirty or dusty conditions. The aiming device of the invention, as illustrated, allows for a mortar barrel to swivel freely and to rotate freely about its own central longitudinal axis, when necessary. Furthermore, the aiming device of the invention, as illustrated, does not add substantially to the weight of the indirect fire weapon and is small compared to an inertial navigation system using gyroscopes. As will be appreciated, an inertial navigation system using gyroscopes is too heavy to use on conventional statically deployed indirect fire weapons such as mortars, which typically has to be carried to position most of the time. Furthermore, a gyroscope needs to be brought to speed which is time-consuming.

The indirect fire weapon aiming device of the invention, as illustrated, provides electronic output signals giving a projectile launcher bearing and elevation and thus allows electronic targeting. This in turn provides a host of advantages, such as digital capturing of target data, e.g. by means of a laser range finder, digital capturing of observation post data, digital transmission of observation post data to a fire base, digital acceptance of observation post data, fire control and/or ballistic computing, digital fire data transmission to an electronic sight, weapon setting with electronic aiming assistance, the firing of a charge according to instructions received from an electronic sight, observation post corrections fed directly to the sight, and the like.

The invention claimed is:

1. An indirect fire weapon aiming device configured to provide aiming information to an indirect fire weapon that comprises an elongate launcher mounted to a base having an upper side, the indirect fire weapon aiming device including an angular displacement sensor configured to be mounted to the base so that it is located on the upper side thereof to provide an angular displacement output; and an azimuth communicator configured (i) releasably to be mounted between ends of the launcher and (ii) mechanically to communicate the launcher azimuth to the angular displacement sensor so that the angular displacement sensor can measure the angular displacement of the launcher relative to a reference bearing and provide the angular displacement output.

2. The indirect fire weapon aiming device according to claim 1, in which the azimuth communicator is configured releasably to be mounted between ends of the launcher such that the launcher is able to rotate about a central longitudinal axis of the launcher, without rotating the azimuth communicator with the launcher.

3. The indirect fire weapon aiming device according to claim 1, in which the azimuth communicator includes a clamp by means of which the azimuth communicator can be mounted between ends of the launcher.

4. The indirect fire weapon aiming device according to claim 3, in which the clamp includes a friction reducer which allows the launcher to rotate within the clamp about a central longitudinal axis of the launcher.

5. The indirect fire weapon aiming device according to claim 3, in which the clamp is configured to allow the launcher to rotate within the clamp about a central longitudinal axis of the launcher while clamping the launcher with the clamp between ends of the launcher, and in which the azimuth communicator includes a mechanical link extending from the clamp mechanically to link the launcher to the angular displacement sensor, the mechanical link including at least two arms hingedly connected to one another and respectively to the clamp and the angular displacement sensor, to allow the launcher elevation to be adjustable.

6. The indirect fire weapon aiming device according to claim 1, in which the azimuth communicator includes a mechanical link which is configured to be mounted at one end between ends of the launcher and at another end to the angular displacement sensor mechanically to link the launcher to the angular displacement sensor while allowing the elevation of the launcher to be adjusted.

7. The indirect fire weapon aiming device according to claim 1, which includes an elevation sensor or clinometer to sense the elevation of the launcher and to provide an elevation output.

8. The indirect fire weapon aiming device according to claim 1, which includes a tilt sensor configured to be mounted to the base to measure the tilt of the base about at least one axis and to provide a tilt output.

9. The indirect fire weapon aiming device according to claim 1, in which the angular displacement sensor includes a reference component configured fixedly to be mounted to an upper side of the base and a displaceable component configured rotatably to be mounted to the reference component and connected to the azimuth communicator, the displaceable component being configured to rotate about an axis passing through a swivel point of the launcher, in use so that azimuth adjustments to a launcher are communicated to the displaceable component through the azimuth communicator, with the displaceable component thus rotating in unison with the launcher.

10. The indirect fire weapon aiming device according to claim 9, which is intended for a mortar, the reference component of the angular displacement sensor being configured to be mounted to a mortar base plate and defining an aperture in use providing access to a socket base on the base plate so that the ball of a breech block of a mortar can be inserted through the reference component onto the socket base.

11. The indirect fire weapon aiming device according to claim 10, in which the displaceable component defines an aperture, aligned with the aperture in the reference component so that the ball of a breech block of a mortar can be inserted through the displaceable component onto the socket base.

12. An indirect fire weapon comprising a launcher mounted or mountable to a base, the weapon further including the aiming device as claimed in claim 1.

13. A mortar aiming device which includes an angular displacement sensor for providing an angular displacement output, the angular displacement sensor being configured to be mounted to a mortar base plate and defining an aperture in use providing access to a socket base on the base plate so that the ball of a breach block of a mortar can be inserted through the angular displacement sensor onto the socket base; and an azimuth communicator configured releasably to be mounted between ends of a barrel of the mortar mechanically to communicate the barrel azimuth to the angular displacement sensor so that the angular displacement sensor can measure the angular displacement of the barrel relative to a reference bearing and provide the angular displacement output.

14. The mortar aiming device according to claim 13, in which the azimuth communicator is configured releasably to be mounted between ends of a barrel of the mortar such that the barrel is able to rotate about a central longitudinal axis of the barrel without rotating the azimuth communicator.

* * * * *